US010703619B2

(12) United States Patent
Njaastad et al.

(10) Patent No.: US 10,703,619 B2
(45) Date of Patent: Jul. 7, 2020

(54) DILUENT MANIFOLD FOR BEVERAGE DISPENSERS

(71) Applicant: Cornelius, Inc., Osseo, MN (US)

(72) Inventors: David K. Njaastad, Palatine, IL (US); Stan Valsaint, San Diego, CA (US); E. Scott Sevcik, Crystal Lake, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 16/294,395

(22) Filed: Mar. 6, 2019

(65) Prior Publication Data

US 2019/0276300 A1 Sep. 12, 2019

Related U.S. Application Data

(60) Provisional application No. 62/640,219, filed on Mar. 8, 2018.

(51) Int. Cl.
*B67D 1/12* (2006.01)

(52) U.S. Cl.
CPC .... *B67D 1/1204* (2013.01); *B67D 2210/0006* (2013.01)

(58) Field of Classification Search
CPC ..... B67D 1/1204
USPC ..... 222/129.1
See application file for complete search history.

(56) References Cited

U.S. PATENT DOCUMENTS 6,935,532 B2 * 8/2005 Tinucci ..... B67D 1/0021 137/595
6,981,615 B2 * 1/2006 Tobler ..... B67D 1/1247 222/129.1
9,622,615 B2 * 4/2017 Hecht ..... A47J 31/52
2004/0245288 A1 * 12/2004 Tobler ..... B67D 1/1247 222/129.1
2005/0230421 A1 10/2005 Morrow, Sr. et al.
2006/0071015 A1 4/2006 Jablonski et al.
2006/0157504 A1 * 7/2006 Barker ..... G05D 11/132 222/129.1

(Continued)

OTHER PUBLICATIONS

Assured Automation, "3-way Sanitary Ball Valves" [online] (retrieved from intemet on Jun. 10, 2019) <URL: https://assuredautomation.com/30D/index.php>, Apr. 22, 2017; entire document.

(Continued)

*Primary Examiner* — Patrick M Buechner
*Assistant Examiner* — Michael J. Melaragno
(74) *Attorney, Agent, or Firm* — Andrus Intellectual Property Law, LLP

(57) ABSTRACT

A beverage dispenser has a diluent manifold that dispensing a first diluent, a second diluent, or a mixed diluent to a beverage dispensing valve that receives and dispense the first diluent, the second diluent, or the mixed diluent with a concentrate from a concentrate source. The diluent manifold has a first inlet configured to receive the first diluent, a second inlet configured to receive the second diluent and an outlet that dispenses the first diluent, the second diluent, or a mixed diluent comprising the first diluent and the second diluent. A flow control spool is included that selectively permits the first diluent, the second diluent, or both the first diluent and the second diluent to convey through the diluent manifold such that the first diluent, the second diluent, or the mixed diluent dispenses from the outlet.

21 Claims, 14 Drawing Sheets

(56) References Cited

U.S. PATENT DOCUMENTS

| | | | | |
|---|---|---|---|---|
| 2007/0215215 | A1 | 9/2007 | Arentsen et al. | |
| 2008/0047973 | A1* | 2/2008 | Elsom | B67D 1/0031 222/57 |
| 2011/0301768 | A1* | 12/2011 | Hammonds | B67D 1/0031 700/285 |
| 2012/0111887 | A1* | 5/2012 | Smeller | A47J 31/402 222/129.1 |
| 2014/0361041 | A1 | 12/2014 | Hawken | |
| 2017/0043992 | A1* | 2/2017 | Green | B67D 1/0864 |

OTHER PUBLICATIONS

International Search Report and Written Opinion, PCT/US2019/021131, dated May 15, 2019.

* cited by examiner

DILUENT MANIFOLD FOR BEVERAGE DISPENSERS

CROSS-REFERENCE TO RELATED APPLICATION

The present disclosure is based on and claims priority to U.S. Provisional Patent Application No. 62/640,219 filed Mar. 8, 2018, the disclosure of which is incorporated herein by reference.

FIELD

The present disclosure relates to diluent manifolds for beverage dispensers.

BACKGROUND

The following U.S. Patents are incorporated herein by reference in entirety.

U.S. Pat. No. 6,981,615 discloses a modular diluent changeover manifold for beverage dispensers that provides quick and convenient changeover of supply of two different beverage liquid diluents to post-mix beverage dispensing valves. The diluent changeover manifold is mounted within a beverage dispenser behind a beverage valve mounting panel. The modular changeover manifold and valve assembly, when assembled, consists of a pair of diluent tubes and a plurality of changeover valves. Each changeover valve has an outlet fluidly connected to an associated one of the beverage dispensing valves and each tube supplies a different diluent, such as plain water and carbonated water, to one of two inlets to each changeover valve. The changeover valves are individually manually manipulatable to deliver to their associated beverage valves either the diluent from the first tube or the diluent from the second tube U.S. Pat. No. 6,935,532 discloses a system for delivering a selected one of two diluents to beverage dispensing valves via a manifold having a plurality of pairs of first and second diluent outlet orifices. One diluent is delivered to all of the first outlet orifices and the other diluent is delivered to all of the second outlet orifices. Hoses coupled at one end to diluent inlets to associated ones of the dispensing valves each have a connector at their opposite end which is adapted to be selectively and releasably connected with either the first or second orifice of an associated pair of orifices in accordance with whichever diluent is to be delivered by the hose to its associated dispensing valve. Stop plugs are releasably inserted into and close the non-selected orifices to prevent escape of diluent from those orifices. A retainer releasably retains the connectors and stop plugs in the orifices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage dispenser has a diluent manifold that dispensing a first diluent, a second diluent, or a mixed diluent to a beverage dispensing valve that receives and dispenses the first diluent, the second diluent, or the mixed diluent with a concentrate from a concentrate source. The diluent manifold has a first inlet configured to receive a first diluent, a second inlet configured to receive a second diluent, and an outlet that dispenses the first diluent, the second diluent, or a mixed diluent comprising the first diluent and the second diluent. A flow control spool is included that selectively permits the first diluent, the second diluent, or both the first diluent and the second diluent to flow through the diluent manifold such that the first diluent, the second diluent, or the mixed diluent dispenses from the outlet.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Post-mix beverage dispensers often include a number of beverage dispensing valves that each dispense a post-mix beverage to the operator. When a beverage dispensing valve is actuated, a flavor syrup concentrate and a diluent (e.g. plain water, carbonated water) are dispensed to the valve and mixed to form the selected mixed beverage. Each valve is often plumbed with a dedicated supply line for a specific diluent. However, as recognized in the above referenced U.S. Patents (which are incorporated by reference), it can be difficult to change the type of diluent supplied to each valve, which is necessary to accommodate new mixed beverages dispensed from the valve. For example, it is often desirable to change the type of mixed beverage, such as from a carbonated soda product (e.g. cola soda) to a non-carbonated mixed beverage (e.g. juice drink). Reconfiguration and/or re-plumbing of the valve to dispense the different diluent can be a tedious, time-consuming, and/or expensive task.

Accordingly, it is advantageous to provide an improved diluent manifold that permits the type of diluent conveyed to each valve to be quickly changed by a technician. Such diluent manifolds preferably allow beverage dispensers to be quickly retrofitted to dispense a variety of post-mix mixed beverages.

The inventors of the present disclosure have endeavored to develop improved diluent manifolds that expand the variety of beverages that can be dispensed from the valves and permit the beverage dispenser to automatically regulate the flow and the pressure of the diluents received and dispensed from the diluent manifold. Through research and experimentation, the present inventors have developed the presently disclosed improved diluent manifolds that permit a blended or mixed diluent formed from more than one diluent to be dispensed to the valve. For example, a "Mid Carb" mixed diluent comprises both plain or still water and carbonated water. Furthermore, the percentage of the first diluent relative to the second diluent in the mixed diluent can be varied by the improved diluent manifolds of the present disclosure. Accordingly, the improved diluent manifolds of the present disclosure allow the beverage dispensers to dispense an increased variety of mixed beverages (e.g. lemonade formed from a lemonade concentrate and carbonated and plain water mixed diluent).

Figure 1:
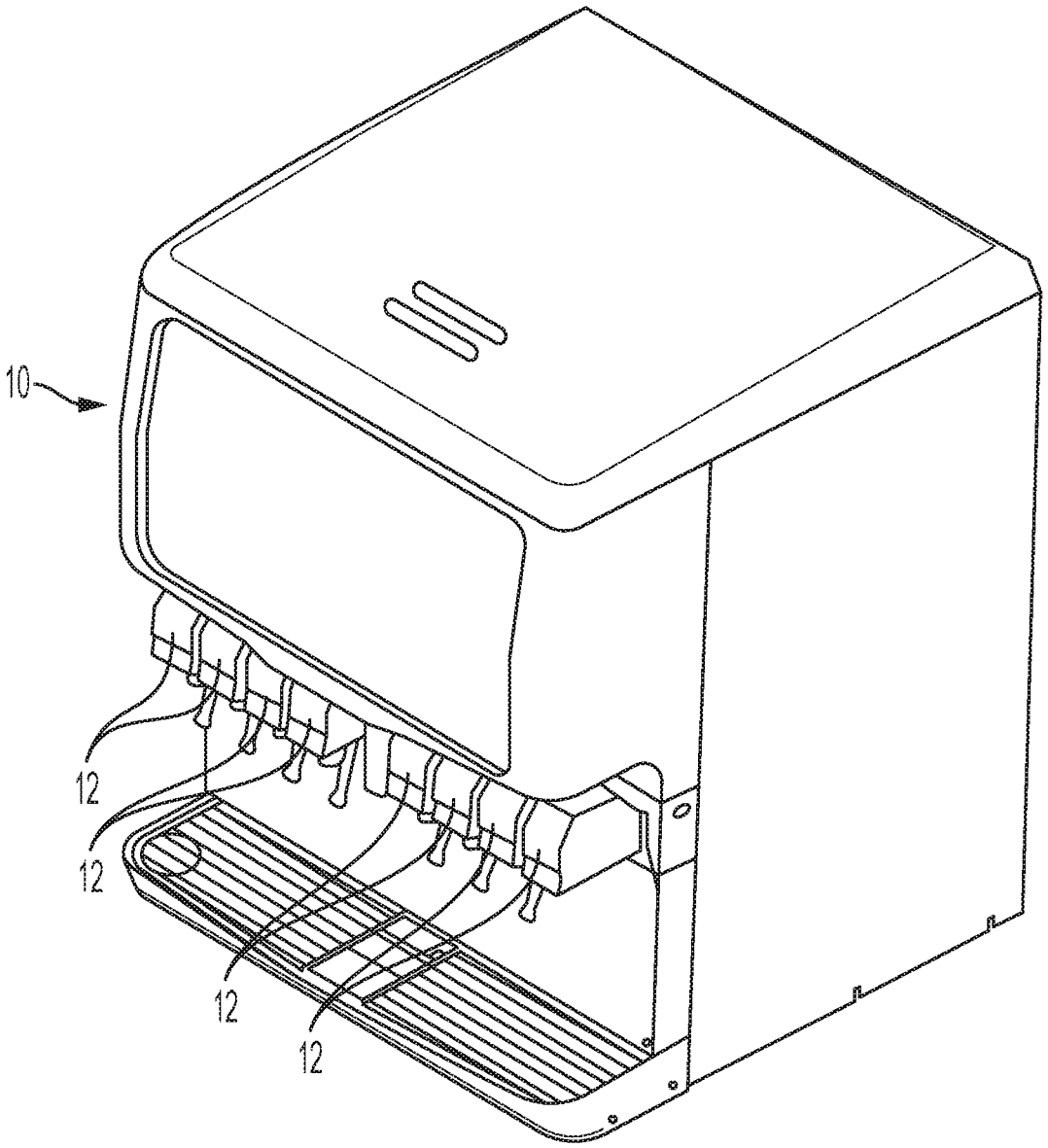
FIG. 1 is a perspective view of an example post-mix beverage dispenser with which a diluent manifold (not shown) of the present disclosure may be used.

FIG. 1 depicts an example post-mix beverage dispenser 10 of the present disclosure. The dispenser 10 can be electrically or ice cooled and the illustrated example includes eight post-mix beverage dispensing valves 12 that dispense post-mix mixed beverages to an operator. The number dispensing valves 12 can vary from what is shown and described. Reference is made to above-incorporated U.S. Pat. No. 6,935,532 which describes an example conventional beverage dispenser with a cooling system.

Referring now to FIGS. 2-5, the diluent manifold 20 is for location in the dispenser 10 (FIG. 1). Reference is made the above-incorporated U.S. Patents for description of conventional components that may be included within the dispenser 10 and/or connected to the manifold 20. As noted above, the manifold 20 permits different types of diluents to be supplied to the valves 12 and further facilitates rapid changeover of the type of diluent supplied to the valves 12. In one non-limiting example, the manifold 20 is capable of dispensing a first diluent D1 (e.g. plain water), a second diluent D2 (e.g. carbonated water), and a mixed diluent D3 (FIG. 2) that comprises a mixture of the first diluent and the second diluent (e.g. the mixed diluent comprises 50% of the first diluent and 50% of the second diluent) to the valves 12. The percentages of the respective diluents D1, D2 that form the mixed diluent D3 can vary. Furthermore, the present inventors have contemplated that the manifold 20 may be capable of receiving and dispensing more than two diluents.

The manifold 20 has a valve body 30 with a first inlet 21 that receives the first diluent D1 from a first diluent source (not shown; e.g. a plain water supply tank) and a second inlet 22 that receives the second diluent D2 form a second diluent source (not shown; e.g. a carbonated water supply tank). A barbed fitting 24 is coupled to each inlet 21, 22, and each barbed fitting 24 has a barbed end 25 that securely couples to a supply hose 26 connected to the diluent sources (not shown), respectively. The diluents D1, D2 are conveyed by a pump (not shown) through the supply hoses 26 to the manifold 20.

The valve body 30 includes a plurality of outlets 31 (FIG. 3) that dispense a desired diluent to the valves 12. A barbed fitting 36 is at each outlet 31, and the each barbed fitting 36 has a barbed end 37 coupled to an outlet hose 38 connected to one of the valves 12. In the example depicted, the valve body 30 has five outlets 31 that dispense the desired diluent to five different valves 12. A person having ordinary skill in the art will recognize that the number of outlets 31 and the number of valves 12 can vary. Furthermore, the type of diluent dispensed from each outlet 31 can vary (e.g., a first outlet dispenses the diluent D1, a third outlet dispenses the second diluent D2, a fifth outlet dispenses a mixed diluent D3).

Figure 2:
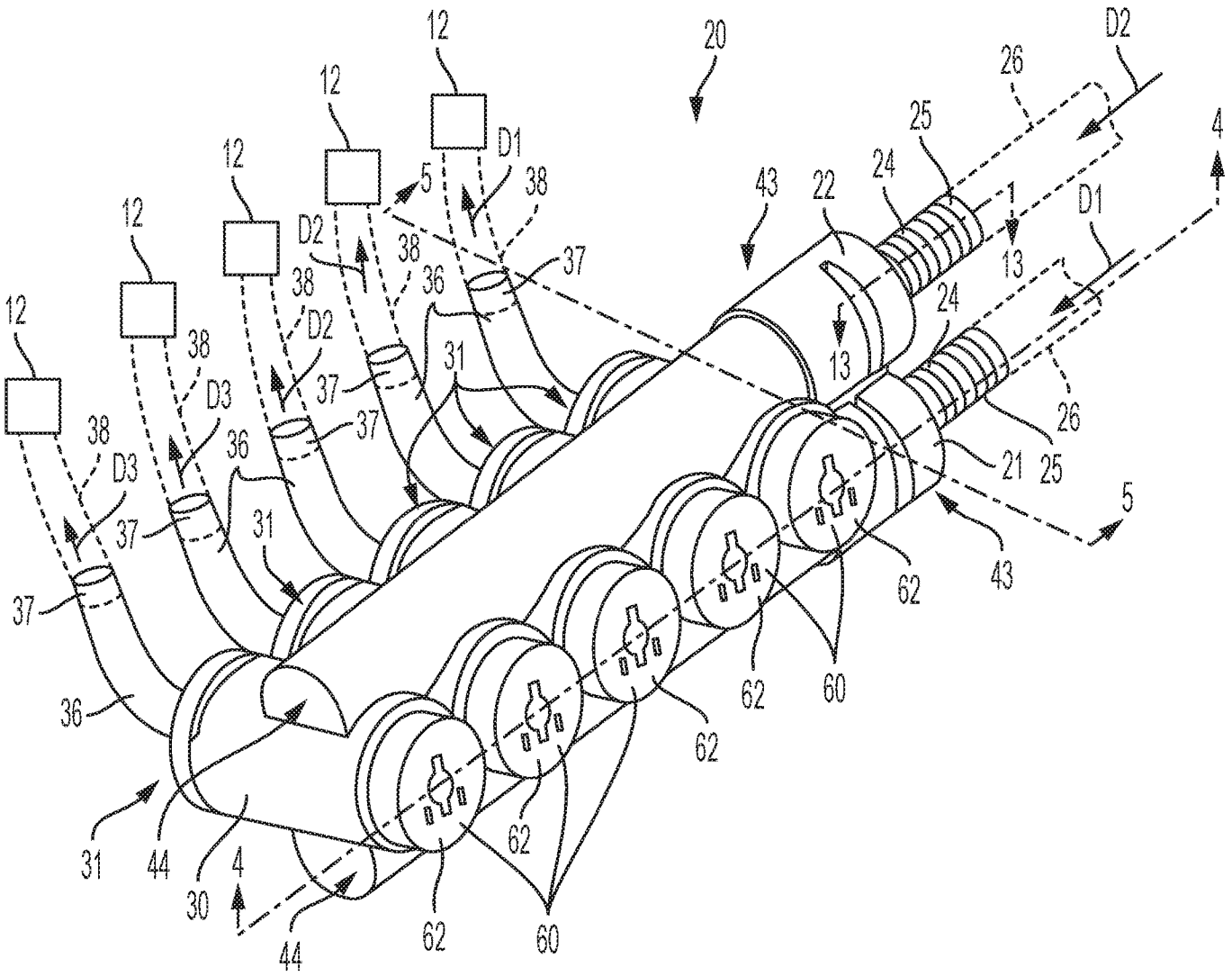
FIG. 2 is a perspective view of the diluent manifold.
Figure 5:
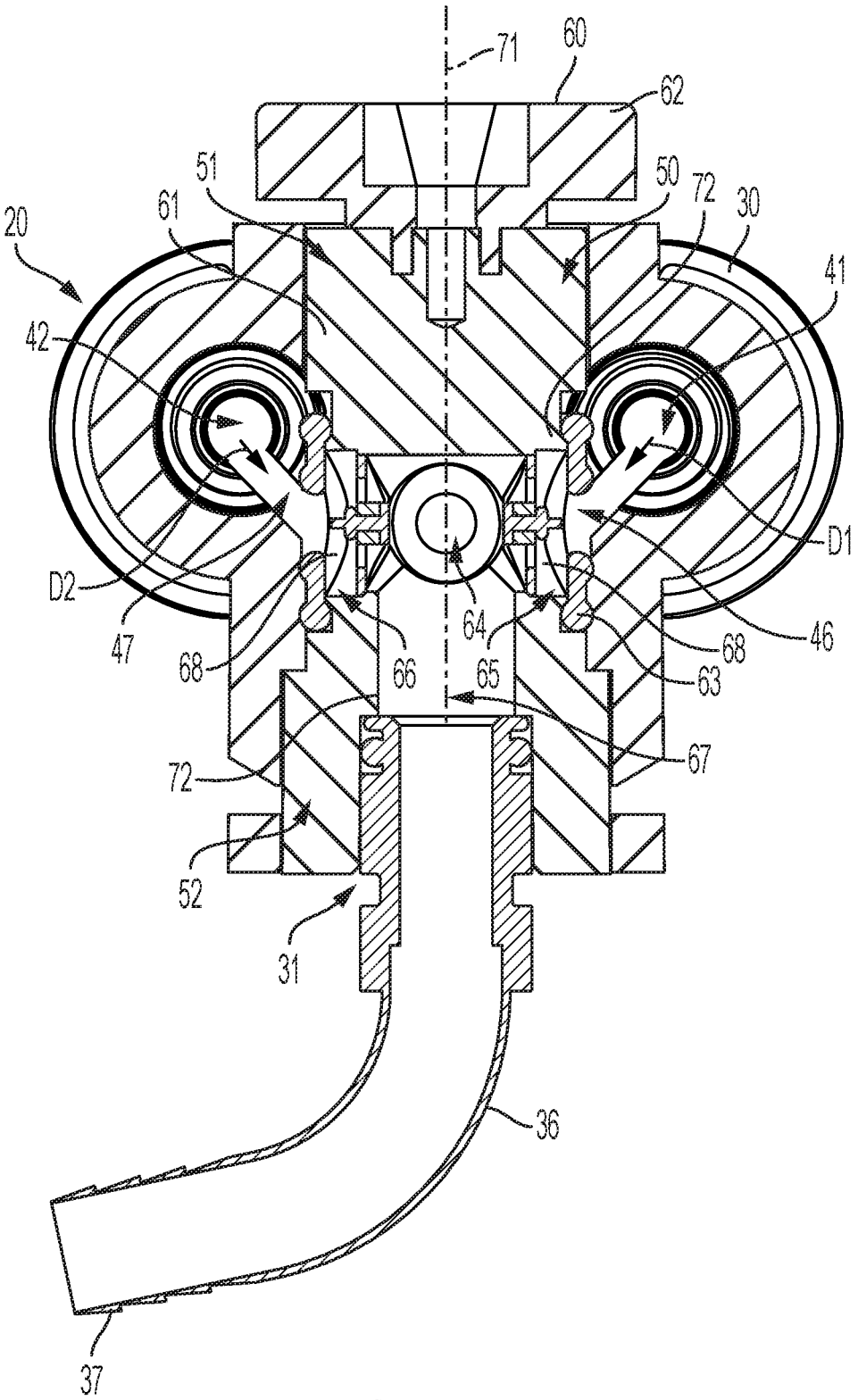
FIG. 5 is a cross sectional view of the diluent manifold along line 5-5 on FIG. 2.

Referring to FIG. 5, the diluents received into the manifold 20 are conveyed through passages 41, 42, respectively, in the valve body 30 to one or more chambers 50 (described herein). The first diluent D1 is conveyed through a first passage 41 and the second diluent D2 is conveyed through a second passage 42. Each passage 41, 42 has an open end 43 (FIG. 2) that receives the diluent D1, D2 and an opposite closed end 44 (FIG. 2). In the example depicted, the passages 41, 42 are spaced apart from each other and extend parallel to each other along the manifold 20 (see also FIG. 9).

Figure 4:
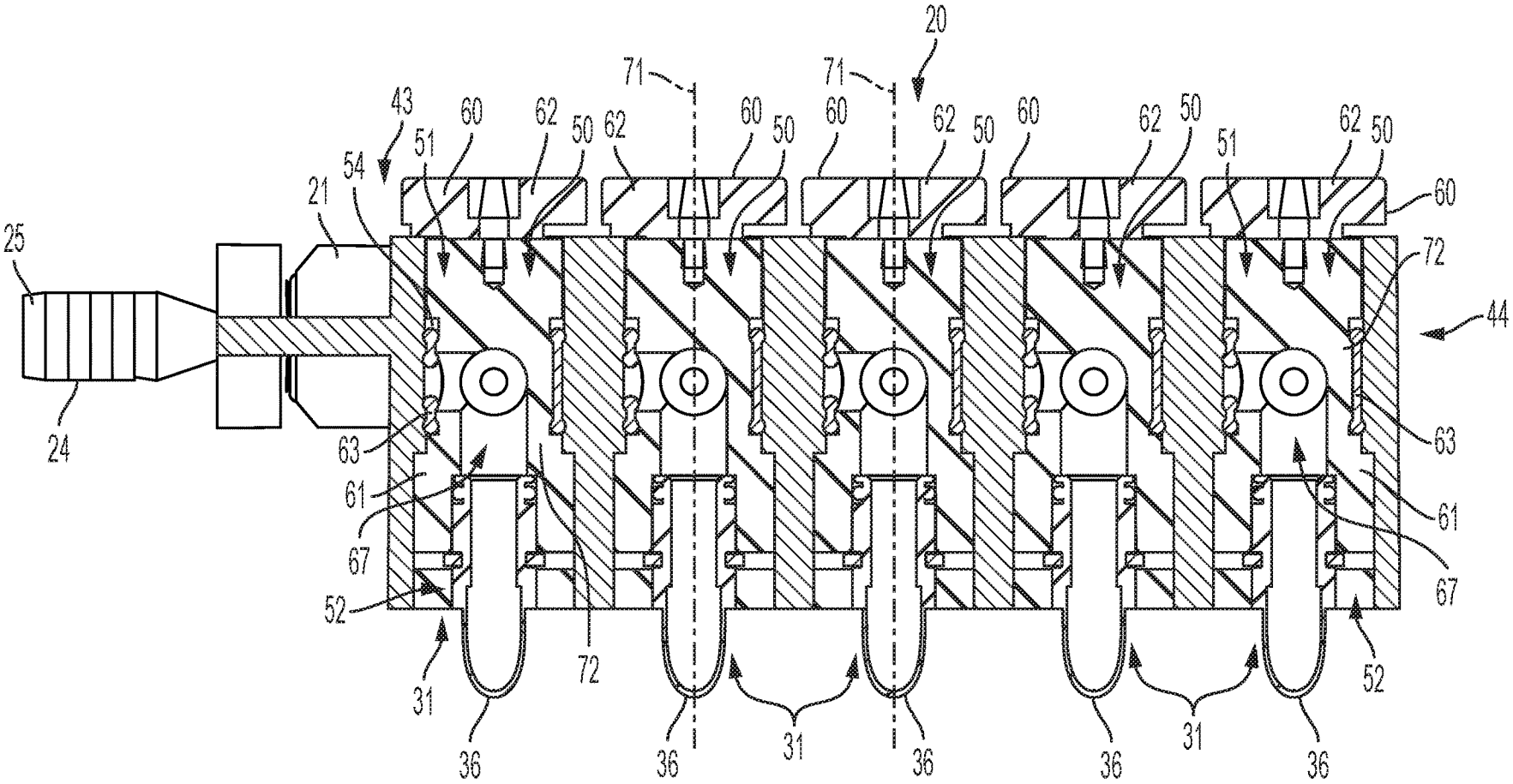
FIG. 4 is a cross sectional view of the diluent manifold along line 4-4 on FIG. 2.

The diluent D1, D2 is further conveyed through orifices 46, 47 into one or more chambers 50. FIG. 5 depicts one set of orifices, a first orifice 46 and a second orifice 47, at a single chamber 50. The first orifice 46 permits the first diluent D1 to be conveyed from the first passage 41 to the chamber 50, and the second orifice 47 permits the second diluent D2 to be conveyed from the second passage 42 to the chamber 50. The chamber 50 has an open end 51 that receives a flow control spool 60, which is described hereinbelow, and an opposite second end 52 at which the barbed fitting 36 that is connected to the valve 12 (FIG. 2) is located. In the example depicted, the chambers 50 extend perpendicular to the passages 41, 42 and are positioned between the passages 41, 42 such that the orifices 46, 47 through the diluents D1, D2 are conveyed into the chambers 50 are opposite each other (see also FIGS. 2 and 9). Referring to FIG. 4, the number of chambers 50 can vary, and in one example, the number of chambers 50 corresponds to the number of outlets 31 (e.g. a manifold 20 with five outlets 31 has five chambers 50).

Figure 6:
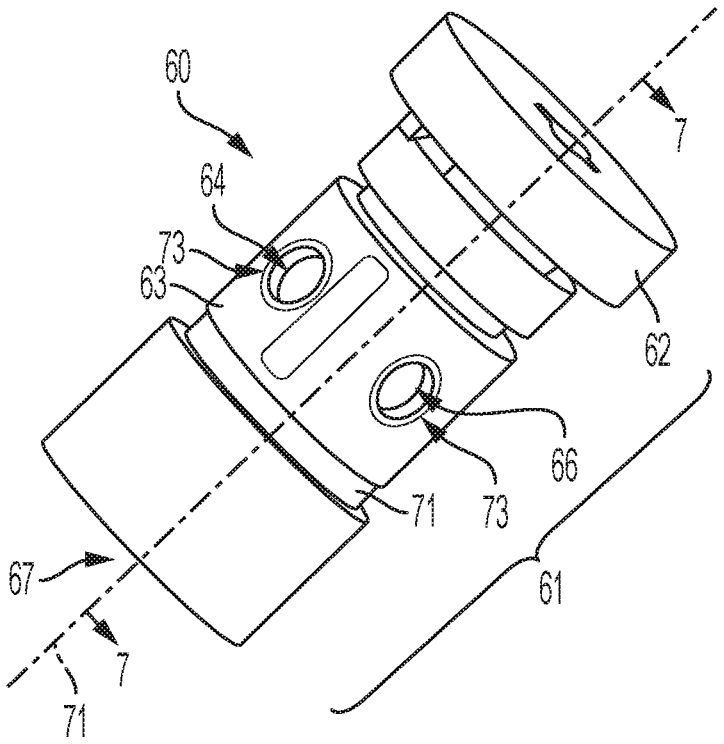
FIG. 6 is a perspective view of an example flow control spool.
Figure 7:
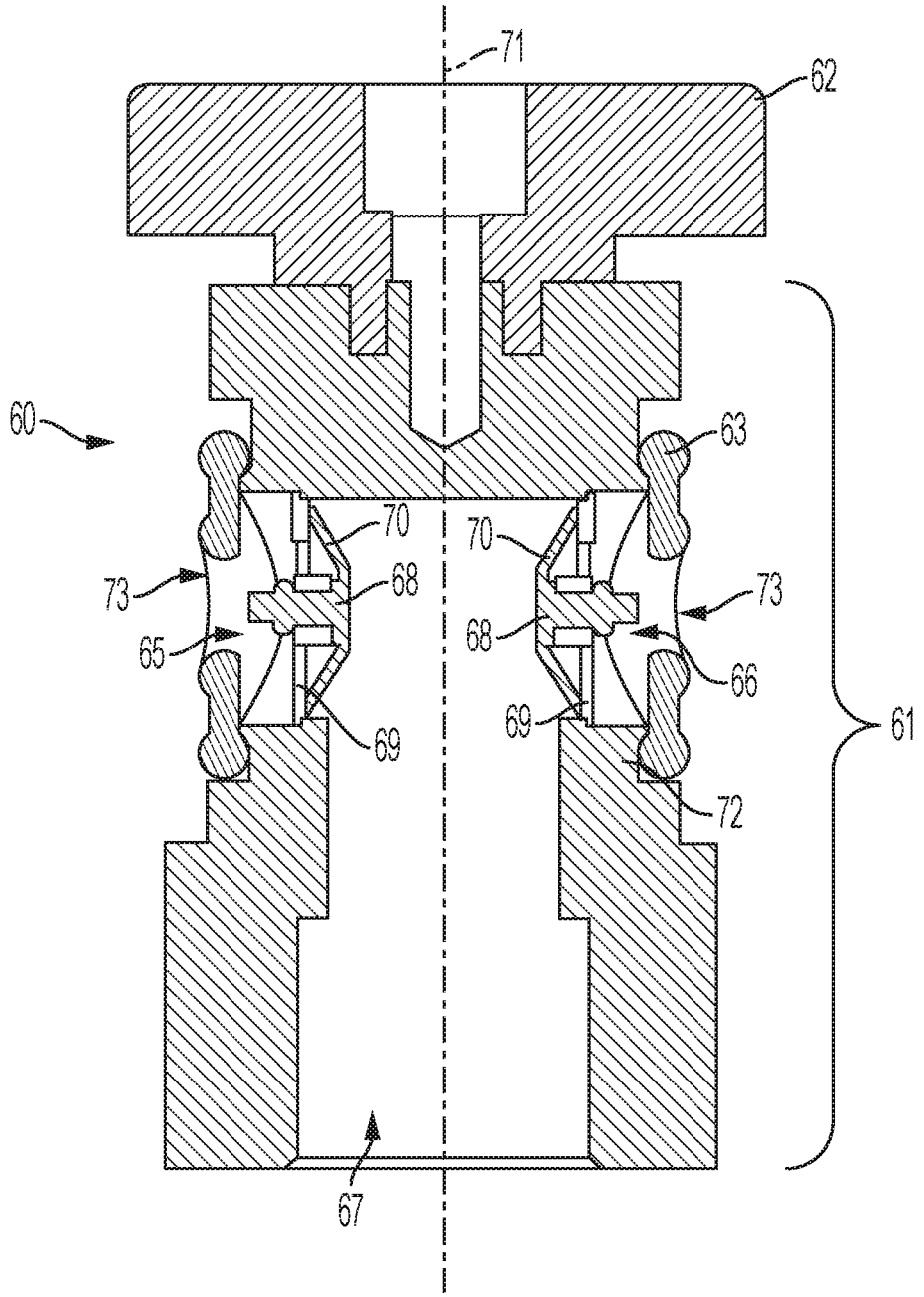
FIG. 7 is a cross sectional view of the flow control spool along line 7-7 on FIG. 6.

FIGS. 6-7 depicts the flow control spool 60 in greater detail. As noted above, a flow control spool 60 is positioned in each chamber 50 (FIG. 5) and is rotatable such that a technician can change the type of diluent conveyed into the chamber 50 and further conveyed to the corresponding outlet 31 (FIG. 4). That is, the flow control spool 60 is rotatable by the technician into different positions (described hereinbelow) in which the flow control spool 60 blocks or permits conveyance of the first diluent D1 and/or the second diluent D2 into the chamber 50 and to the outlet 31 (FIG. 4). Details and operation of the flow control spool 60 are described hereinbelow.

Still referring to FIGS. 6-7, the flow control spool 60 generally includes a spool body 61 that is received into the chamber 50 (FIG. 5), a selector knob 62 that extends out of the chamber 50 (FIG. 5), and a flexible member 63 that encircles the spool body 61. The spool body 61 extends along an axis 71 and is generally cylindrically shaped with a center bore 67 (FIG. 7). The spool body 61 has a sidewall 72 in which a plurality of openings 64, 65, 66 are defined. As will be described hereinbelow, as the flow control spool 60 is rotated into different position one or more openings 64, 65, 66 align with the one or both of the orifices 46, 47 (FIG. 5) such that one or both diluents D1, D2 are conveyed into the center bore 67 and the chamber 50 (FIG. 5) and further to the corresponding outlet 31 (FIG. 4) and the corresponding valve 12.

The openings 64, 65, 66 are spaced apart along the sidewall 72. For example, the openings 64, 65, 66 are positioned ninety rotational degrees away from each other. Note that the openings 64, 65, 66 may be spaced apart from each other at various rotational degrees of separation (e.g. 30 degrees, 60 degrees). A person having ordinary skill in the art will recognize that the number of openings 64, 65, 66 can vary. In the example depicted in FIGS. 6-7, the flow control spool 60 has three openings 64, 65, 66, namely a first opening 64, a second opening 65, and a third opening 66 (note that the first opening 64 is not visible in FIG. 7 and the second opening 65 is not visible in FIG. 6). The second opening 65 and the third opening 66 are opposite each other, and the first opening 64 is positioned between the second opening 65 and the third opening 66.

Figure 8:
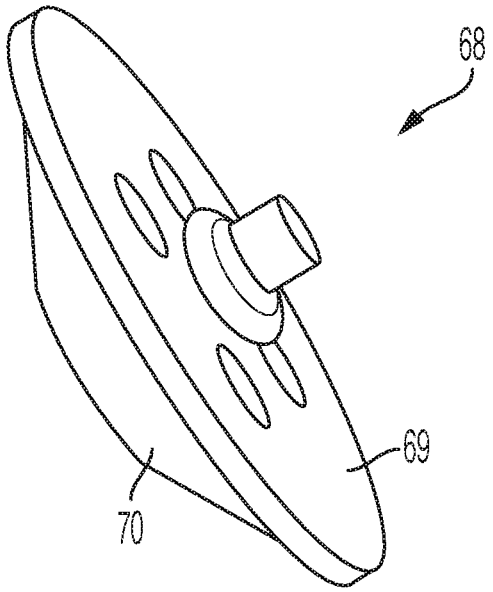
FIG. 8 is a perspective view of an example of an example check valve.

A check valve 68 (FIG. 7) is at one or more of the opening 64, 65, 66 and is for preventing the diluent(s) D1, D2 downstream in the center bore 67 and the chamber 50 (FIG. 5) from back flowing through the openings 64, 65, 66 and into the passages 41, 42 (FIG. 5). An example check valve 68 is also shown in FIG. 8. The check valve 68 has an orifice plate 69 and a flexible seal 70 configured to selectively seal the orifice plate 69. In operation, as the diluent D1, D2 is conveyed through the opening 64, 65, 66 (FIG. 7) the diluent D1, D2 passes through the orifice plate 69 which thereby causes the flexible seal 70 to flex (e.g. open) such that the diluent D1, D2 is conveyed into the center bore 67. However, when the diluent D1, D2 is not being conveyed (e.g. an upstream pump stops pumping the diluent D1, D2 because there is no demand for the diluent D1, D2) the flexible seal 70 seals the orifice plate 69 thereby preventing any diluent D1, D2 in the center bore 67 from back flowing through the opening 64, 65, 66 and into the passage 41, 42 (FIG. 5). As such, the check valve 68 prevents diluent D1, D2 in the center bore 67 from contaminating the diluent D1, D2 in the passages 41, 42. In certain examples, the flexible seal 70 is frusto-conical.

In another example, the check valve 68 is configured to open and/or closed (e.g. seal) based on the relative pressure of the diluent D1, D2 upstream of the check valve 68 and the pressure of the diluent D1, D2 downstream of the check valve 68. That is, when the pressure of the diluent D1, D2 in the center bore 67 is greater than the pressure of the diluent D1, D2 in the passage 41, 42 (FIG. 5) the flexible seal 70 closes (e.g. contacts, collapses onto) the orifice plate 69 to thereby prevent the diluent D1, D2 in the center bore 67 from moving into the passage 41, 42 (FIG. 5). Conversely, when the pressure of the diluent D1, D2 in the passage 41, 42 (FIG. 5) is equal to or greater than the pressure of the diluent D1, D2 in the center bore 67 the flexible seal 70 flexes open and/or does not contact the orifice plate 69. As such, the diluent D1, D2 is conveyed from the passage 41, 42 into the center bore 67. In other examples, the difference of the pressures of the diluents D1, D2 upstream and downstream of the check valve 68 must be within a predetermined range (e.g. the difference in pressures of the diluents D1, D2 is 1.0-2.0 PSI) for the diluent D1, D2 is conveyed into the center bore 67.

As noted above, the flow control spool 60 has a flexible member 63 (FIGS. 6-7) that encircles the spool body 61. When the flow control spool 60 is received into the chamber 50 (FIG. 5), the flexible member 63 creates a fluid-tight seal between the flow control spool 60 and the interior surface 54 (FIG. 4) of the chamber 50. The flexible member 63 has a plurality of holes 73 that align with the opening 64, 65, 66. In one example, the flexible member 63 is a flexible band.

As is also noted above, the flow control spool 60 has a selector knob 62 that extends out of the chamber 50 (FIG. 5) such that the selector knob 62 can be engaged by the technician to thereby rotate the flow control spool 60 into different positions that correspond to the location of the openings 64, 65, 66. That is, the selector knob 62 permits the flow control spool 60 to be rotated into and between different positions such that the desired openings 64, 65, 66 in the sidewall 72 align with the orifices 46, 47 to thereby permit conveyance of the desired diluent(s) D1, D2 into the chamber 50 and to the outlet 31 (FIG. 5). The selector knob 62 includes indicia so that the technician can quickly recognize the position the flow control spool 60 is in.

Example operation of the flow control spool 60 and rotation of the flow control spool 60 into different positions is described in greater detail hereinbelow with respect to FIGS. 9-12.

Figure 9:
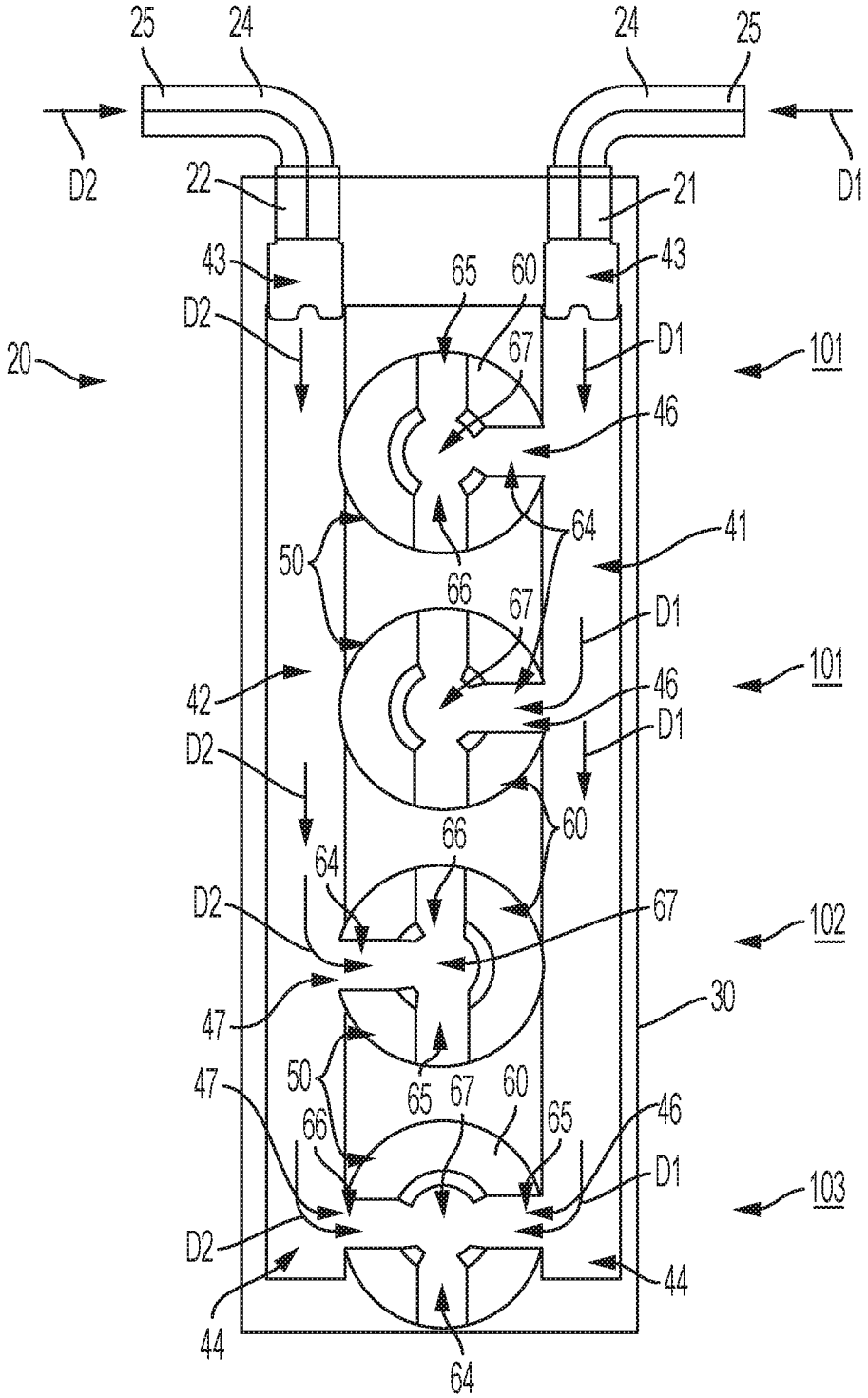
FIG. 9 is a cross sectional view of another example diluent manifold of the present disclosure.

FIG. 9 is a cross sectional view of another example diluent manifold 20. The manifold 20 has four flow control spools 60 located in four chambers 50 (see FIG. 5). The flow control spools 60 are shown in different positions for illustrative purposes and labeled as such: a first position 101, a second position 102, and a third position 103. Each flow control spool 60 can be rotated into and between the different positions 101, 102, 103. The positions are described in greater detail hereinbelow.

Figure 10:
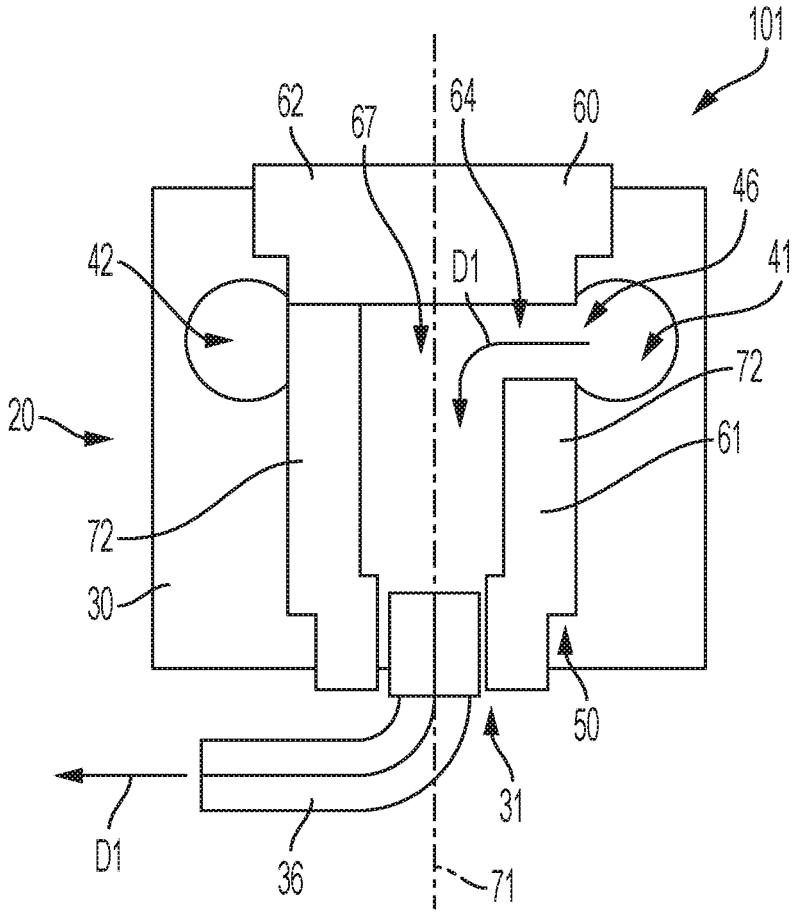
FIG. 10 is a cross sectional view of an example flow control spool in a chamber of the diluent manifold of FIG. 9. The flow control spool is in a first position.

Referring to FIG. 10, the flow control spool 60 is shown rotated into the first position 101. In the first position, the first opening 64 is in fluid communication with (e.g. aligned with) the first orifice 46 such that the first diluent D1 can be conveyed from the first passage 41 into the center bore 67 and to the outlet 31. The sidewall 72 of the spool body 61 blocks the second orifice 47 (FIG. 9) such that the second diluent D2 cannot be conveyed into the center bore 67. As is best shown in FIG. 9, when the flow control spool 60 is in the first position 101 the second and third opening 65, 66 are not aligned with either orifice 46, 47.

Figure 11:
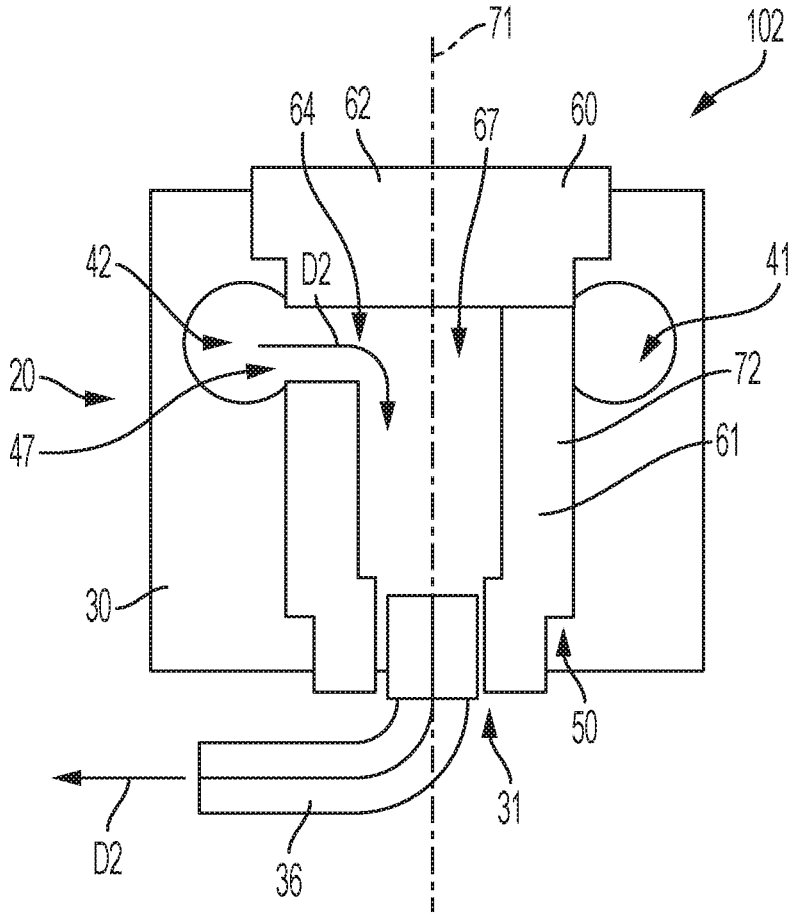
FIG. 11 is view like FIG. 10 with the flow control spool in a second position.

Referring now to FIG. 11, the flow control spool 60 is rotated into the second position 102 in which the first opening 64 is in fluid communication with (e.g. aligned with) the second orifice 47 such that the second diluent D2 can be conveyed from the second passage 42 into the center bore 67 and to the outlet 31. The sidewall 72 of the spool body 61 blocks the first orifice 46 (FIG. 9) such that the first diluent D2 cannot be conveyed into the center bore 67. As is best shown in FIG. 9, when the flow control spool 60 is in the second position 102 the second and third opening 65, 66 are not aligned with either orifice 46, 47.

Figure 12:
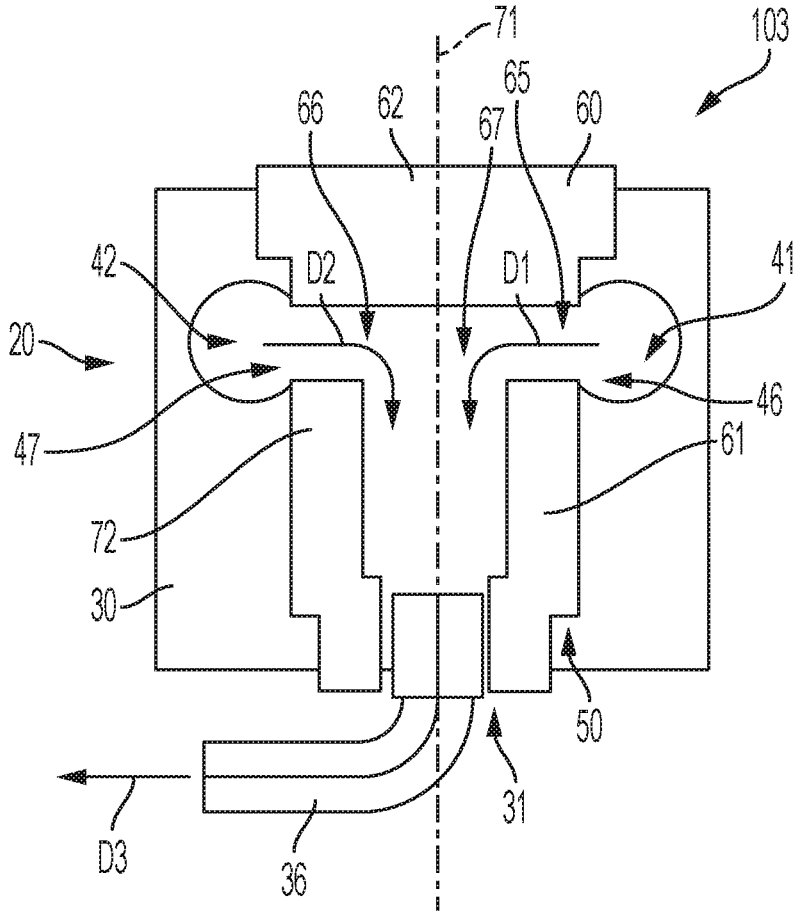
FIG. 12 is a view like FIG. 10 with the flow control spool in a third position

Referring now to FIG. 12, the flow control spool 60 is rotated into the third position 103 in which the second opening 65 is in fluid communication with (e.g. aligned with) the first orifice 46 such that the first diluent D1 can be conveyed from the first passage 41 into the center bore 67 and the third opening 66 is in fluid communication with (e.g. aligned with) the second orifice 47 such that the second diluent D2 can be conveyed from the second passage 42 into the center bore 67. Accordingly, the first and second diluents D1, D2 are mixed together in the center bore 67 to form the mixed diluent D3 that is dispensed via the outlet 31. As is best shown in FIG. 9, when the flow control spool 60 is in the third position 103 the first opening 64 is not aligned with either orifice 46, 47.

The amount of rotation necessary to rotate the flow control spool 60 into and between the various positions can vary, and the in the example depicted in FIG. 9 the flow control spool 60 is rotated ninety degrees between different positions. In this example, the flow control spool 60 is rotated one hundred eighty degrees between the first position 101 and the second position 102.

A person of ordinary skill in the art will recognize that the flow control spool 60 can be rotated into a fourth position (not shown) that mirrors the third position 103. That is, in the fourth position the second opening 65 is aligned with the second orifice 47 such that the second diluent D2 can be conveyed from the second passage 42 into the center bore 67 and the third opening 66 is aligned with the first orifice 46 such that the first diluent D1 can be conveyed from the first passage 41 into the center bore 67. A person ordinary skill in the art will also recognize that the flow control spool 60 can be rotated into a fully closed position that is between the positions 101, 102, 103 noted above. For example, if the flow control spool 60 is rotated forty-five degrees from one of the positions 101, 102, 103 none of the openings 64, 65, 66 will be aligned with the orifices 46, 47 and therefore the diluents D1, D2 cannot be conveyed into the center bore 67.

Figure 13:
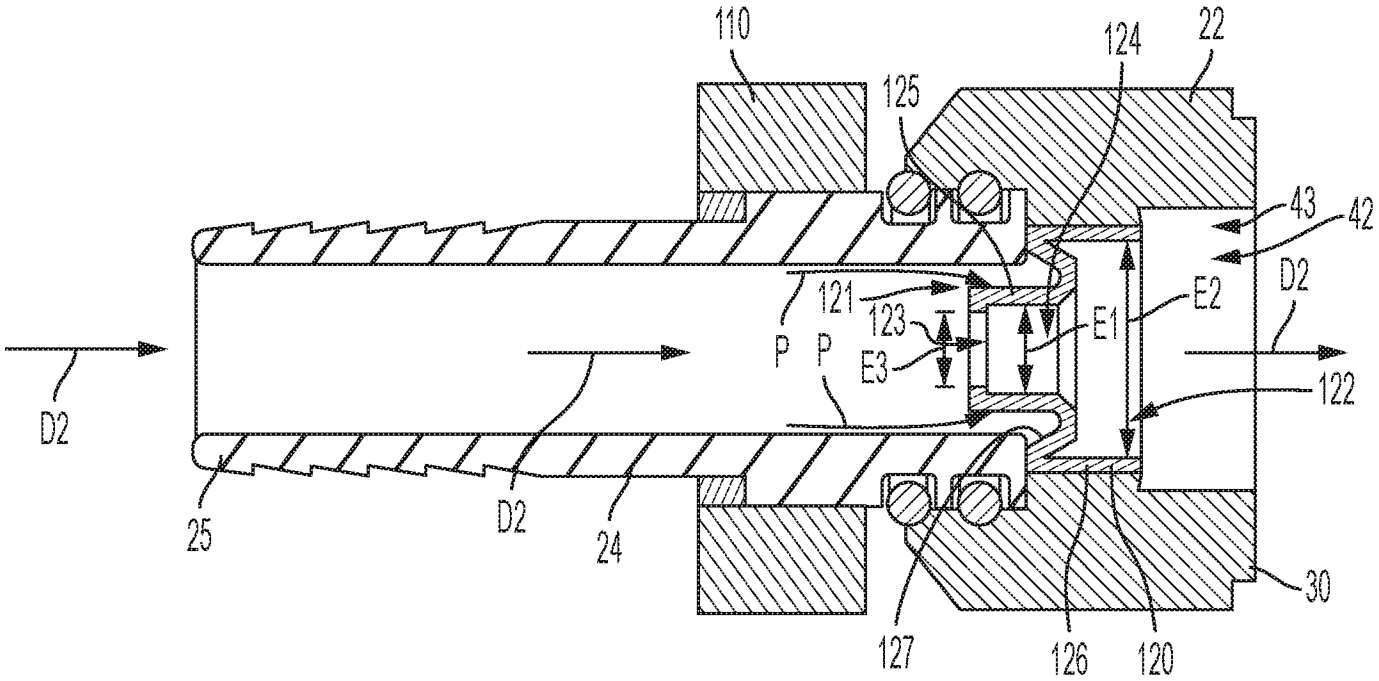
FIG. 13 is a cross sectional view at a second diluent inlet of the diluent manifold of FIG. 1 along line 13-13 on FIG. 1.

Referring to FIG. 13, an enlarged cross sectional view of the second inlet 22 is depicted. A pressure regulator 120 is positioned at the second inlet 22 to thereby regulate the pressure of the second diluent D2 through the manifold 20. Specifically, the pressure regulator 120 is inserted into the second inlet 22 and the barbed fitting 24 is then placed into the second inlet 22. A clip 110 (described further herein) is then coupled to the barbed fitting 24 to prevent the barbed fitting 24 from disconnecting from the second inlet 22.

The pressure regulator 120 has an upstream end 121 with a pressure regulator aperture 123 and a downstream end 122. A bore 124 extends through the pressure regulator 120 and varies in diameter. For example, the diameter E1 of the bore 124 at the upstream end 121 is less than the diameter E2 of the bore 124 at the downstream end 122. Furthermore, the diameter E3 of the aperture 123 is less than the diameter E1 of the upstream end 121. The upstream end 121 has first sidewall 125 that is spaced apart from the barbed fitting 36 and the second inlet 22. The downstream end 126 has a second sidewall 126 that contacts the valve body 30. A material fold 127 extends between the sidewalls 125, 126 is elastically movable as the first sidewall 125 is compressed and uncompressed by the second diluent D2 acting on the first sidewall (see arrows P) so as to prevent the second sidewall 126 along the valve body 30 from moving as the first sidewall 125 moves (described hereinbelow).

During operation, the second diluent D2 acts on (e.g. applies a force on) the pressure regulator 120 (see pressure arrows P) such that the first sidewall 125 is compressed radially inwardly and the diameter E3 of the aperture 123 is constricted. Accordingly, the amount and flow of the second diluent D2 that can pass through the pressure regulator 120 is restricted. In this manner, the pressure regulator 120 controls the flow and the pressure of the second diluent D2 conveyed into the manifold 20. In certain examples, the pressure regulator 120 controls the flow and the pressure of the second diluent D2 to a desired flow rate (e.g. 0.5 ounces per second) and/or a desired pressure (e.g. 40.0 pounds per square inch PSI) regardless of the flow rate and/or the pressure of the second diluent D2 upstream of the pressure regulator 120. For example, when the pressure of the second diluent D2 received is 50.0 PSI, the diameter E3 of the aperture 123 is constricted such that the pressure of the second diluent D2 through the pressure regulator 120 is reduced to 40.0 PSI. In another example, when the pressure of the second diluent D2 received is 80.0 PSI, the diameter E3 of the aperture 123 further constricted (relative to the example above with respect to the second diluent D2 received at 50.0 PSI) such that the pressure of the second diluent D2 through the pressure regulator 120 is reduced to 40.0 PSI The present inventors have discovered that controlling the pressures of the diluent(s) D1, D2 conveyed into the manifold 20 is important for properly mixing the diluents together to form a desired mixed diluent D3. In certain examples, the pressures of the diluents D1, D2 should be equal or within a predetermined range (e.g. 1.0-2.0 PSI) for proper mixing. In other examples, the pressures of the diluents D1, D2 may be varied relative to each other (e.g. the first diluent D1 is at 38.0 PSI and the second diluent D2 is at 40.0 PSI) such that the composition of the mixed diluent D3 can be varied (e.g. the mixed diluent D3 comprising 40.0% of the first diluent D1 and 60.0% of the second diluent D2).

Figure 3:
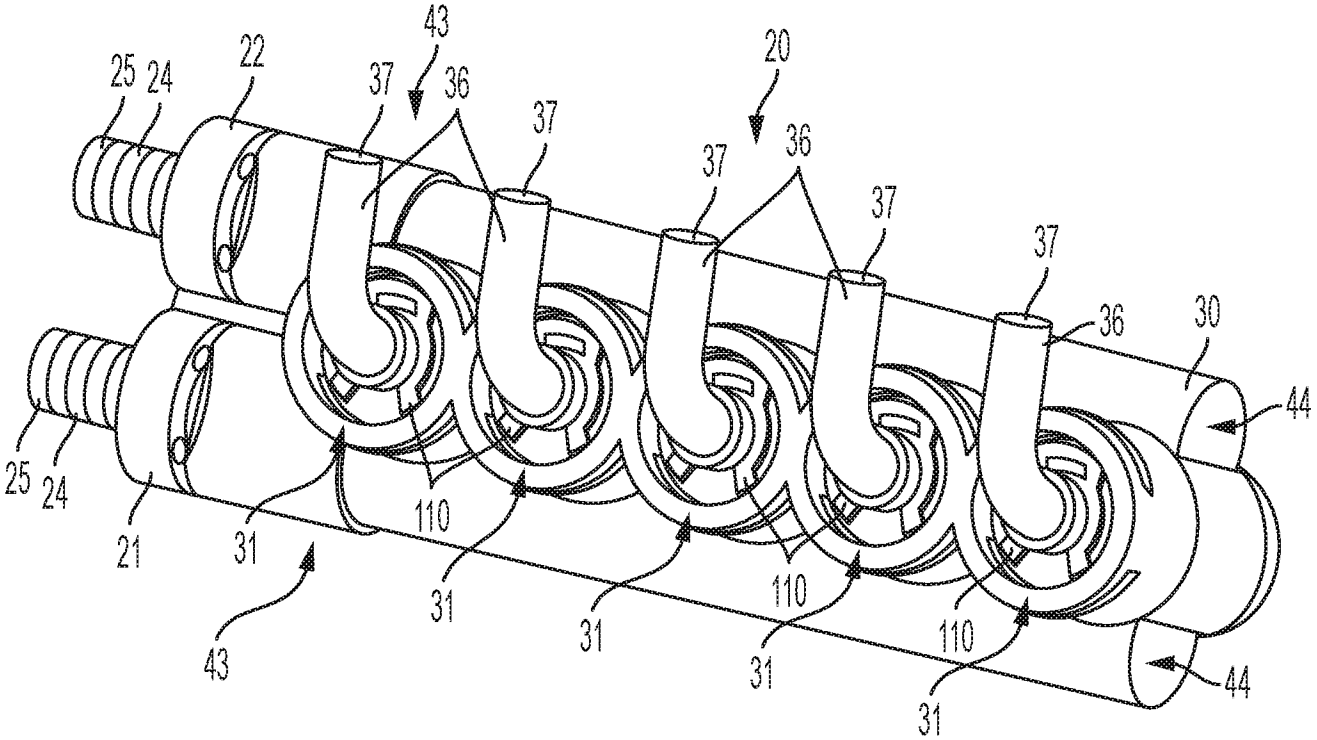
FIG. 3 is another perspective view of the diluent manifold.
Figure 14:
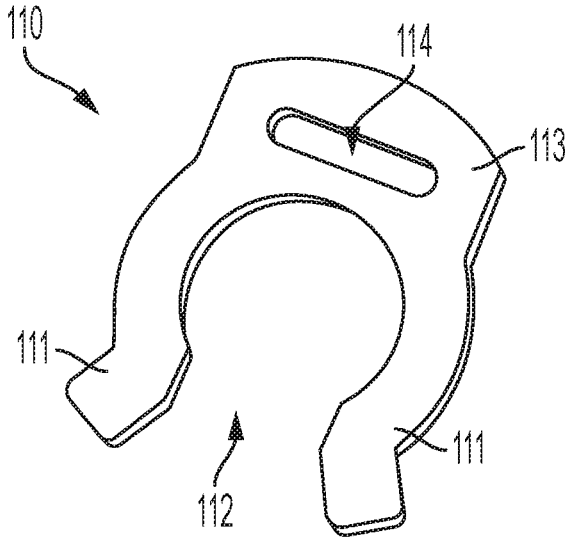
FIG. 14 is a perspective view of an example clip.

In certain examples, the manifold 20 includes clips 110 (FIG. 14) that prevent components of the manifold 20 described hereinabove from separating from each other (see FIG. 3). FIG. 14 depicts an example clip 110 in greater detail, and the clip 110 has a pair of resilient legs 111, a center opening 112 between the legs 111, and a tab 113 with a cutout 114 defined therein. Referring to FIGS. 3 and 13, the legs 111 of the clip 110 are positioned around the barbed fitting 24, 36 and the barbed fitting 24, 36 is received in the center opening 112 to thereby prevent the barbed fitting 24, 36 from decoupling from the manifold 20. A person having ordinary skill in the art will recognize that the shape of the clip 110 can vary.

In certain examples, a beverage dispenser has a diluent manifold with a first inlet configured to receive a first diluent, a second inlet configured to receive a second diluent, and an outlet that dispenses the first diluent, the second diluent, or a mixed diluent comprising the first diluent and the second diluent. A flow control spool selectively permits the first diluent, the second diluent, or both the first diluent and the second diluent to convey through the diluent manifold such that the first diluent, the second diluent, or the mixed diluent dispenses from the outlet. A beverage dispensing valve that receives and dispenses a mixed beverage formed from a concentrate from a concentrate source and one of the first diluent, the second diluent, and the mixed diluent from the diluent manifold. The diluent manifold has a chamber between the inlets and the outlet, a first orifice through which the first diluent is conveyed into the chamber, and a second orifice through which the second diluent is conveyed into the chamber. The flow control spool is in the chamber and rotatable to thereby alternately block the first orifice and prevent the first diluent from conveying into the chamber, block the second orifice and prevent the second diluent from conveying into the chamber, and permit the first diluent to convey through the first orifice and the second diluent to convey through the second orifice into the chamber. The flow control spool has a first opening, a second opening, and a third opening spaced apart from each on the flow control spool. When the first opening is aligned with the first orifice the first diluent is conveyed into the chamber and to the outlet. When the first opening is aligned with the second orifice the second diluent is conveyed into the chamber and to the outlet. When the second opening is aligned with the first orifice and the third opening is aligned with the second orifice the first diluent and the second diluent are conveyed into the chamber and to the outlet.

In certain examples, the flow control spool has a center bore and a cylindrical sidewall in which the first, second, and third openings are defined. The flow control spool has a check valve at each of the second and third openings to prevent the first diluent, the second diluent, or both the first diluent and the second diluent in the center bore from back flowing through the second and third openings. Each check valve has an orifice plate and a flexible seal configured to open as the first diluent or the second diluent is conveyed through the orifice plate. The flexible seal closes to thereby seal the orifice plate and prevent conveyance of the first diluent or the second diluent through the orifice plate when the pressure of the first diluent or the second diluent upstream from the check valve is less than the pressure of the first diluent or the second diluent downstream from the check valve. The flexible seal is frusto-conical in shape.

In certain examples, the first opening is between the second opening and the third opening. The flow control spool has a cylindrical sidewall in which the first, second, and third openings are defined, and the first opening is positioned ninety rotational degrees away from the second opening and the third opening. The flow control spool is rotatable into and between: a first position in which the first opening is aligned with the first orifice; a second position in which the first opening is aligned with the second orifice; a third position in which the second opening is aligned with the first orifice and the third opening is aligned with the second orifice; and a fourth position in which the third opening is aligned with the first orifice and the second opening is aligned with the third orifice. The control spool is rotated ninety degrees between each position. In certain examples, the flow control spool is rotated one hundred eighty degrees between the first position and the second position.

In certain examples, the flow control spool has a flexible member that contacts an interior surface of the chamber to thereby create a fluid-tight seal between the flow control spool and the chamber. The flexible member is a flexible band with holes that align with the first, second, and third openings. The diluent manifold has a pressure regulator that regulates pressure of the second diluent conveyed through the diluent manifold to a desired predetermined diluent pressure such that the mixed diluent dispensed through the outlet is at a predetermined flow ratio of the first diluent and the second diluent. The pressure regulator has an upstream end with an aperture, a downstream end, and a bore extending between the upstream end and the downstream end, and wherein the aperture is configured to be constricted to thereby restrict flow and decrease pressure of the second diluent conveyed through the diluent manifold. The upstream end of the pressure regulator has a first sidewall that is configured to radially inwardly compress under pressure from the second diluent to thereby constrict the aperture. The downstream end has a second sidewall, and wherein an elastic material fold extends between the first sidewall and the second sidewall and is configured to flex as the first sidewall is radially inwardly compressed. The bore at the upstream end has a first diameter that is less than a second diameter at the downstream end.

In the present description, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

What is claimed is:

1. A beverage dispenser comprising:

a diluent manifold having:

a first inlet configured to receive a first diluent;

a second inlet configured to receive a second diluent;

an outlet that dispenses the first diluent, the second diluent, or a mixed diluent comprising the first diluent and the second diluent; and a flow control spool that selectively permits the first diluent, the second diluent, or both the first diluent and the second diluent to convey through the diluent manifold such that the first diluent, the second diluent, or the mixed diluent dispenses from the outlet; and a beverage dispensing valve that receives and dispenses a mixed beverage formed from a concentrate from a concentrate source and one of the first diluent, the second diluent, and the mixed diluent from the diluent manifold.

2. The beverage dispenser according to claim 1, wherein the diluent manifold further comprises a chamber between the inlets and the outlet, a first orifice through which the first diluent is conveyed into the chamber, and a second orifice through which the second diluent is conveyed into the chamber;

wherein the flow control spool is in the chamber and rotatable to thereby alternately block the first orifice and prevent the first diluent from conveying into the chamber, block the second orifice and prevent the second diluent from conveying into the chamber, and permit the first diluent to convey through the first orifice and the second diluent to convey through the second orifice into the chamber.

3. The beverage dispenser according to claim 2, wherein the flow control spool has a first opening, a second opening, and a third opening spaced apart from each other on the flow control spool;

wherein when the first opening is aligned with the first orifice the first diluent is conveyed into the chamber and to the outlet;

wherein when the first opening is aligned with the second orifice the second diluent is conveyed into the chamber and to the outlet; and wherein when the second opening is aligned with the first orifice and the third opening is aligned with the second orifice the first diluent and the second diluent are conveyed into the chamber and to the outlet.

4. The beverage dispenser according to claim 3, wherein the flow control spool has a center bore and a cylindrical sidewall in which the first, second, and third openings are defined.

5. The beverage dispenser according to claim 3, wherein the flow control spool has a check valve at each of the second and third openings to prevent the first diluent, the second diluent, or both the first diluent and the second diluent in the center bore from back flowing through the second and third openings.

6. The beverage dispenser according to claim 5, wherein each check valve has an orifice plate and a flexible seal configured to open as the first diluent or the second diluent is conveyed through the orifice plate.

7. The beverage dispenser according to claim 6, wherein the flexible seal closes to thereby seal the orifice plate and prevent conveyance of the first diluent or the second diluent through the orifice plate when the pressure of the first diluent or the second diluent upstream from the check valve is less than the pressure of the first diluent or the second diluent downstream from the check valve.

8. The beverage dispenser according to claim 6, wherein the flexible seal is frusto-conical in shape.

9. The beverage dispenser according to claim 3, wherein the first opening is between the second opening and the third opening.

10. The beverage dispenser according to claim 3, wherein the flow control spool has a cylindrical sidewall in which the first, second, and third openings are defined, and wherein the first opening is positioned ninety rotational degrees away from the second opening and the third opening.

11. The beverage dispenser according to claim 3, wherein the flow control spool is rotatable into and between:

a first position in which the first opening is aligned with the first orifice;

a second position in which the first opening is aligned with the second orifice;

a third position in which the second opening is aligned with the first orifice and the third opening is aligned with the second orifice; and a fourth position in which the third opening is aligned with the first orifice and the second opening is aligned with the third orifice.

12. The beverage dispenser according to claim 11, wherein the flow control spool is rotated ninety degrees between each position.

13. The beverage dispenser according to claim 11, wherein the flow control spool is rotated one hundred eighty degrees between the first position and the second position.

14. The beverage dispenser according to claim 3, wherein the flow control spool has a flexible member that contacts an interior surface of the chamber to thereby create a fluid-tight seal between the flow control spool and the chamber.

15. The beverage dispenser according to claim 14, wherein the flexible member is a flexible band with holes that align with the first, second, and third openings.

16. The beverage dispenser according to claim 3, wherein the diluent manifold has a pressure regulator that regulates pressure of the second diluent conveyed through the diluent manifold to a desired predetermined diluent pressure such that the mixed diluent dispensed through the outlet is at a predetermined flow ratio of the first diluent and the second diluent.

17. The beverage dispenser according to claim 16, wherein the pressure regulator has an upstream end with an aperture, a downstream end, and a bore extending between the upstream end and the downstream end, and wherein the aperture is configured to be constricted to thereby restrict flow and decrease pressure of the second diluent conveyed through the diluent manifold.

18. The beverage dispenser according to claim 17, wherein the upstream end of the pressure regulator has a first sidewall that is configured to radially inwardly compress under pressure from the second diluent to thereby constrict the aperture.

19. The beverage dispenser according to claim 18, wherein the downstream end has a second sidewall, and wherein an elastic material fold extends between the first sidewall and the second sidewall and is configured to flex as the first sidewall is radially inwardly compressed.

20. The beverage dispenser according to claim 18, wherein the bore at the upstream end has a first diameter that is less than a second diameter at the downstream end.

21. A beverage dispenser comprising:

a diluent manifold having:

a first inlet configured to receive a first diluent;

a second inlet configured to receive a second diluent;

an outlet configured to dispense the first diluent, the second diluent, or a mixed diluent comprising the first diluent and the second diluent; and a flow control spool configured to selectively permit:

the first diluent to convey through the diluent manifold and dispense from the outlet;

the second diluent to convey through the diluent manifold and dispense from the outlet; or both the first diluent and the second diluent to convey together through the diluent manifold and dispense from the outlet as the mixed diluent; and a beverage dispensing valve configured to dispense a mixed beverage formed from a concentrate from a concentrate source and one of the first diluent, the second diluent, and the mixed diluent from the diluent manifold.

* * * * *